United States Patent [19]

Upton

[11] Patent Number: 4,480,939

[45] Date of Patent: Nov. 6, 1984

[54] SOAP HOLDING AND DISPENSING MEANS

[76] Inventor: Garthop Upton, 1218 Montego, Arroyo Grande, Calif. 93420

[21] Appl. No.: 453,773

[22] Filed: Dec. 27, 1982

[51] Int. Cl.[3] ..... A47K 7/02

[52] U.S. Cl. ..... 401/201; 132/88.7

[58] Field of Search ..... 206/77.1, 0.5; 248/359, 248/360; 401/201, 48; D6/89; 119/159; 241/602; D3/42, 39, 48, 50, 52, 53; D28/73, 76; 132/88.5, 88.7

[56] References Cited

U.S. PATENT DOCUMENTS

| | | | |
|---|---|---|---|
| D. 246,680 | 12/1977 | Sabol | D3/42 |
| D. 246,940 | 1/1978 | Sabol | D3/42 |
| 1,513,463 | 10/1924 | Kidder | D3/42 |
| 1,577,861 | 3/1926 | Henry | 401/201 |
| 1,598,574 | 8/1926 | Gibson | 401/201 |
| 2,035,014 | 3/1936 | Schaefer | 401/201 |
| 2,156,940 | 5/1939 | Graham | 401/201 |
| 2,607,940 | 8/1952 | Miller | 401/201 |
| 3,114,928 | 12/1963 | Spiteri | 401/201 |
| 3,124,827 | 3/1964 | Hull | 401/201 |
| 3,167,805 | 2/1965 | Zuppinger et al. | 401/201 |
| 3,847,122 | 11/1974 | Gould | 119/159 |
| 4,228,834 | 10/1980 | Desnick | 401/201 |

FOREIGN PATENT DOCUMENTS

| | | | |
|---|---|---|---|
| 659965 | 5/1938 | Fed. Rep. of Germany | 248/359 |
| 217729 | 2/1942 | Fed. Rep. of Germany | D6/89 |

*Primary Examiner*—Richard J. Apley
*Assistant Examiner*—Carolyn A. Harrison
*Attorney, Agent, or Firm*—John H. Crowe

[57] ABSTRACT

A soap holder and dispenser suitable for installation and use in a shower. It includes a pouch formed from synthetic netting material sized to receive a bar of soap and a hanger with a hook which supports the pouch in the shower. The pouch has a pocket for the soap and a pair of integral flaps extending upwardly away from the pocket walls. The outer ends of the flaps are fastened together and provided with an eyelet of a size to fit the hook so that the pouch can be hung on it. The flaps are of sufficient length to provide openings between their side edges through which a bar of soap can be passed into the pocket of the pouch. The hook is integral with a shaft mounted in a plastic base designed for attachment to the shower wall with a suitable adhesive. The soap holder and dispenser is positioned for use within easy reach of one using the shower so that a bar of soap in the pouch can be used without taking it out of the pouch, the lather thus generated being readily available to the bather through the mesh openings of the netting walls of the pouch.

3 Claims, 12 Drawing Figures

SOAP HOLDING AND DISPENSING MEANS

BACKGROUND OF THE INVENTION

This invention relates generally to combination soap holding and dispensing means, and more particularly to such means adapted for use with bar soap.

While toilet soap in bar form is no doubt by far the most common type of soap employed in households, hotels, motels, etc., the use of soap in this form has certain longstanding disadvantages which have not as yet, to my knowledge, been successfully overcome. For one thing, it is virtually impossible for a bar of soap to be completely consumed because it eventually becomes so small as to be ineffectual for further use in the normal way. The majority of persons no doubt discard the bar when it becomes this small, which results in a significant loss of soap in the long run. This wastage represents a significant item of expense, especially in a large family where there are heavy daily demands for soap for use in showers and for other bathing purposes.

Another characteristic of bar soap resulting in loss through waste is its tendency to soften when kept in conventional soap trays or the like between periods of use. This softening reduces a bar of soap to a slushy, gelatinous consistency on its underside, even, in many cases, where it is supported in such a way as to permit the drainage of moisture from the bar and the circulation of air therearound. Not only is such softening wasteful of soap, but it renders a bar less attractive in appearance and gives it a mushy, unpleasant texture and feel.

Another problem with bar soap results from its slippery surface when wet which makes the bar hard to hold onto. As a result, wet soap is often dropped, which is annoying, especially when this occurs in a shower stall. It is not uncommon for one to drop a bar of soap several times while taking a shower, making it necessary to repeatedly bend over and pick it up, often where there is scarcely space enough to permit such bending. Sometimes the bar, when dropped, will split into two or more pieces, which obviously results in more soap wastage. This is annoying enough to a person in good physical condition, but when the person is handicapped in a way to make if difficult for him to retrieve a dropped bar of soap, the dropping becomes a serious problem instead of a mere annoyance. In some cases of disability, for example, where a person is seriously afflicted with arthritis in his hands, it's hard for the disabled individual to grip a bar of soap even before it becomes slippery, and virtually impossible to hold onto the bar after it gets wet. Also, a blind person dropping a bar of soap in a shower will obviously have more of a problem than a person with good eyesight who does the same thing.

Dispensers of liquid and powdered soaps, while useful to some extent under some circumstances, are not, for the most part, suitable substitutes for bar soap. For one thing, neither type of dispenser is very effective for use in a shower. A powdered soap dispenser mounted in a shower stall is obviously so unsuitable for use in that environment that no one, to my knowledge, has ever attempted such a thing. Neither, insofar as I am aware, has there been any serious attempt to install liquid soap dispensers in showers. While liquid soaps are available in pump-type dispensers, it is awkward and inconvenient to use such a dispenser in a shower as anyone who has ever attempted to do so has discovered. Furthermore, such usage results in soap wastage because the soap is dispensed in measured amounts from such dispensers, which do not necessarily coincide with the amounts actually required. Certain handicapped persons, for example those crippled by arthritis, moreover, would find the use of liquid soap dispensers in showers (or anywhere else) difficult, if not impossible, to manage.

Thus, while bar soap has been in widespread usage throughout the world for many decades, if not centuries, it has always been plagued by the above-mentioned, and other, shortcomings which no one has heretofore, to my knowledge, succeeded in eliminating. If these shortcomings could somehow be successfully overcome, bar soap would, I believe, be in even more universal demand than it is now, particularly among handicapped persons, and, additionally, could be used with significantly less waste, hence lower cost, than it now can. Also, this would ultimately result in a savings in energy because the energy going into the manufacture of presently wasted soap would not be dissipated in the form of the unused soap.

SUMMARY OF THE INVENTION

I have now, by this invention, succeeded in providing a unique soap holder which serves also as soap dispensing means and which, by virtue of its manner of functioning, permits the complete consumption of bar soap, so that none is wasted, as well as supporting the soap in a fixed position of use so that it will not fall in a shower or elsewhere, thus eliminating any necessity for retrieving a dropped bar of soap. As a result, the soap can be used by persons so severely handicapped as to be incapable of using bar soap by itself, such as, for example, persons with severe arthritis, multiple sclerosis, muscular dystrophy and other crippling diseases. Moreover, since the soap holder of this invention maintains the soap in a fixed position from which it cannot escape, a blind person can use it with ease and without ever having to grope for a lost bar of soap. Because the soap is never dropped, the common hazard, particularly to the handicapped, resulting from the presence of a slippery bar of soap on the floor of a shower, or in a bathtub, is never present when the novel soap holder of this invention is employed.

In its preferred form, my unique soap holding and dispensing means comprises a pouch or sack formed from synthetic netting material sized to receive a bar of soap, and cooperating means to support and maintain the pouch or sack in a convenient position for use in a shower, over a bathtub, by a washbasin or sink, or anywhere else where soap is required near a source of water. A preferred form of synthetic netting material is nylon tulle having a mesh size of from about 1 to about 10 mm., although other synthetic netting materials, such as polyester or the like materials, and other mesh sizes can be employed within the scope of my invention. The pouch serves to support a bar of soap in hanging suspension in a suitable position for use when needed. While the mesh size of the netting material from which the pouch is formed can, as indicated, vary, its mesh openings should, for best effectiveness, be small enough to block the passage of pieces of soap until the pieces are small enough to constitute neglibible waste if lost. As a practical matter, the maximum dimension of such mesh openings should not, I feel, be of more than about ¾-inch size.

Various means for supporting my novel soap holding pouch in a convenient position of use can be employed within the scope of my invention. One form of such support means, particularly suitable for use in a shower stall, consists of a hook arrangement adapted for mounting on a wall, and cooperating eyelet means on the pouch to permit hanging of the latter on the hook. In another form, the pouch supporting means can comprise an upright stem curved through an arc at the top and terminating in a hook for supporting said pouch above a countertop or the like. Many other types of pouch supporting means can be provided to permit the positioning of my soap holding pouch in any of numerous positions, such as, for example, suspended beneath a medicine chest or kitchen cabinet, hanging from a tree branch (for the convenience of campers), etc.

In addition to overcoming the above-mentioned disadvantages of conventional bar soap usage (soap wastage, difficulty of soap handling by the handicapped, etc.), my novel soap holding and dispensing means possesses advantages not present where bars of soap are used in the ordinary way. Thus, where my novel pouch with a load of soap is removable from its supporting means (which, as will be seen, is true of many embodiments of my invention, it can be used directly (without a washcloth) for bathing purposes, and the rough texture of the netting from which it is made serves to stimulate the skin, remove dead flakes therefrom, etc., better than an ordinary washcloth does. Moreover, it cleanses with much less lather than is required when a bar of soap and washcloth are used in the conventional manner, I have determined.

The soap in my novel soap holding and dispensing means hangs in suspension between periods of use and air circulates freely through the netting in which it is confined so that both soap and netting dry quickly and exhibit substantially no drip. Consequently, in addition to preventing the softening and dripping of wet soap such as occurs in conventional soap dishes and the like to create gelatinous residues therein (and result in much soap wastage), the use of my novel soap holder eliminates the necessity of cleaning up such residues, a messy chore now required in most bathrooms, kitchens, etc.

Because of the various ways in which soap loss is prevented through the use of the soap holder and dispenser of this invention, a bar of soap, I have noted, will last from about two to about five times as long when used in the holder than when it is used in the conventional fashion. This is convincing evidence, I believe, that the holder effects soap conservation not only in the above-mentioned ways, but by minimizing the amount of lather dispensed in use, by comparison with the copious quantities of lather generated under ordinary use conditions.

When a bar of soap in the novel pouch of my soap holder becomes too small for further practical usage, it is not removed from the pouch, but a new bar is simply placed in the pouch with it. In this way, no solid soap is ever discarded because any soap scrap in the pouch simply remains there until it is used up. I have noticed that the netting walls of the pouch appear to imbed themselves in the surface of the soap through continued exposure of the soap and netting to water in use, and that this helps to stabilize the soap and netting against excessive slippage therebetween. As will be evident, even where the netting is of a small mesh size, there is a high proportion of open space to mesh strand area in the netting to permit extensive exposure of the surface of the soap bar for lather producing purposes.

It is thus a principal object of the present invention to provide means whereby bar soap can be conveniently consumed in toto so that none is wasted through discard of remnants too small for use in the conventional way.

It is another object of the invention to provide such means conductive to preservation of the soap in firm, usable condition until it is completely consumed, with no significant softening or dripping between periods of use.

Still another object of the invention is to provide such means for retaining a bar of soap readily available at a convenient position for use from which it cannot be dropped.

Still another object of the invention is to provide such means permitting the blind or otherwise handicapped to use bar soap without risk of having it slip from their hands, even where they are so severely handicapped as to be unable to otherwise grasp and hold the soap.

Still another object of the invention is to provide such means capable of use with bar soap in lieu of a washrag and in a manner to vigorously cleanse and stimulate the skin.

Other objects, features and advantages of the invention will become apparent in the light of subsequent disclosures herein.

DESCRIPTION OF THE PREFERRED EMBODIMENTS

Figure 1:
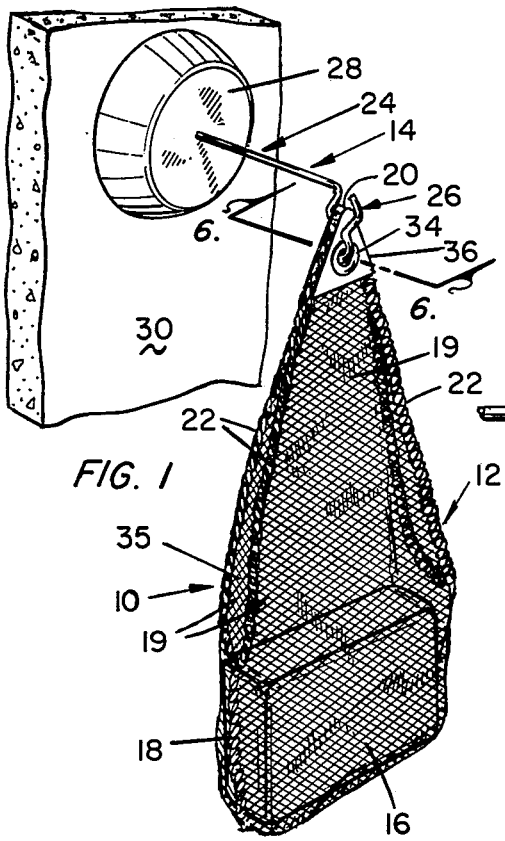
FIG. 1 is a perspective view of a preferred embodiment of a soap holder and dispenser in accordance with this invention attached to a wall and holding a bar of toilet soap.
Figure 2:
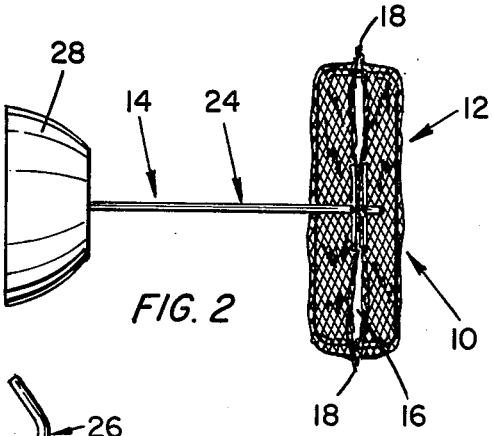
FIG. 2 is a top plan view of the soap holder and dispenser and bar of soap.

FIGS. 1 through 6 show a representative embodiment of my soap holder and dispenser at 10 (hereinafter referred to as soap holder 10). Soap holder 10 comprises two cooperating parts, a basket-like hanging part 12, sized to accommodate a bar of soap, and a hanger 14 which supports the hanging part for use. The hanging part 12 is formed in the shape of a sack-like pouch from a flexible netting of a man-made synthetic organic material such as nylon, polyester or the like, nylon tulle being my preferred netting for the purpose. Since the hanging part 12 (hereinafter referred to as pouch 12) is formed from netting, it has see-through walls with much open space between its mesh strands. This is illustrated in the drawings by the clearly visible presence of a bar of soap 16 in pouch 12 in FIGS. 1 through 5.

The pouch 12 is formed from a strip of suitable netting which has been cut to the proper pattern, folded midway between its ends and sewn part way up its superimposed edges from the centerfold to provide a pocket sized to receive a bar of soap such as that shown at 16, the sewn side edges or seams of this pocket being visible at 18 in the drawings. Extending away from the pocket are two flaps 19, each of which converges to a point 20, best shown in FIG. 1. The edges of these flaps are selvaged with stitching 22 which is similar to the stitching 18 at the side seams of the aforesaid pocket. The stitching 22 is not a critical feature of pouch 12, but is highly desirable in order to strengthen the flaps 19 and help keep their edges intact.

Figure 5:
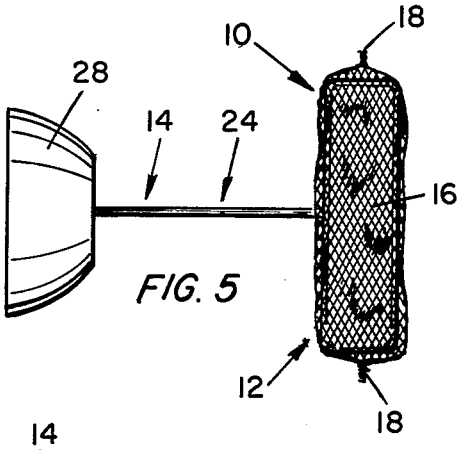
FIG. 5 is a bottom plan view of the soap holder and dispenser and bar of soap.
Figure 3:
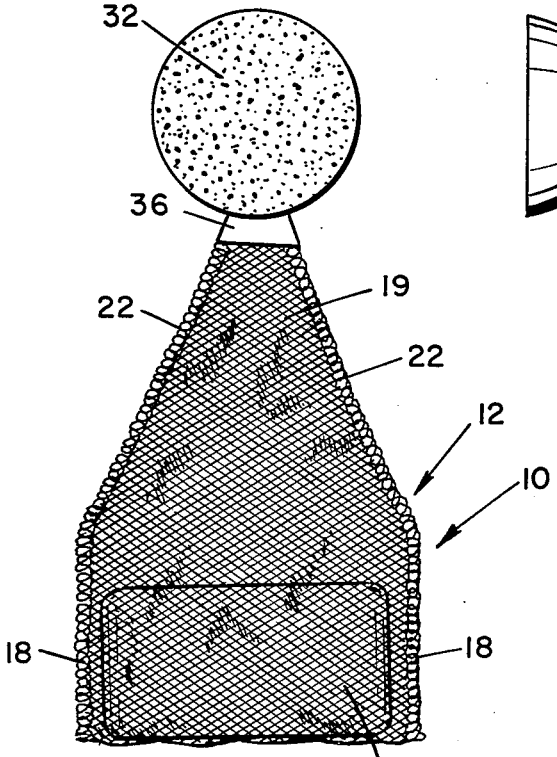
FIG. 3 is a rear elevational view of the soap holder and dispenser and bar of soap.
Figure 4:
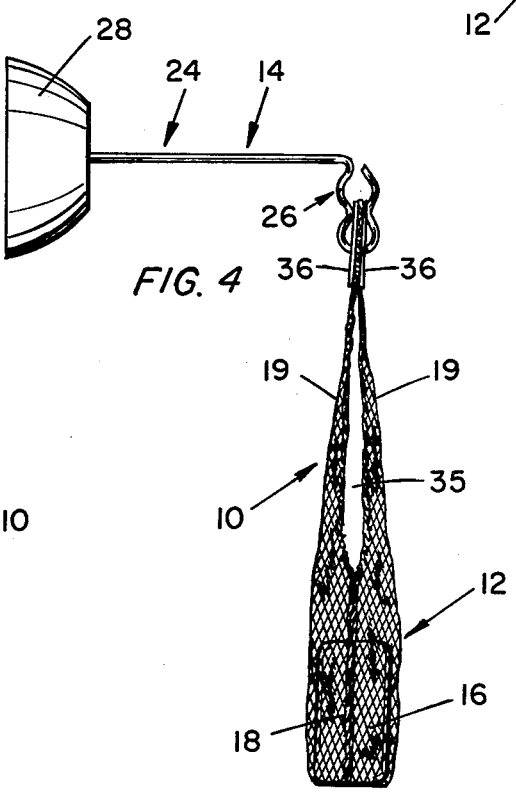
FIG. 4 is a side elevational view of the soap holder and dispenser and bar of soap, the opposite side elevational view being a substantial mirror image thereof.
Figure 7:
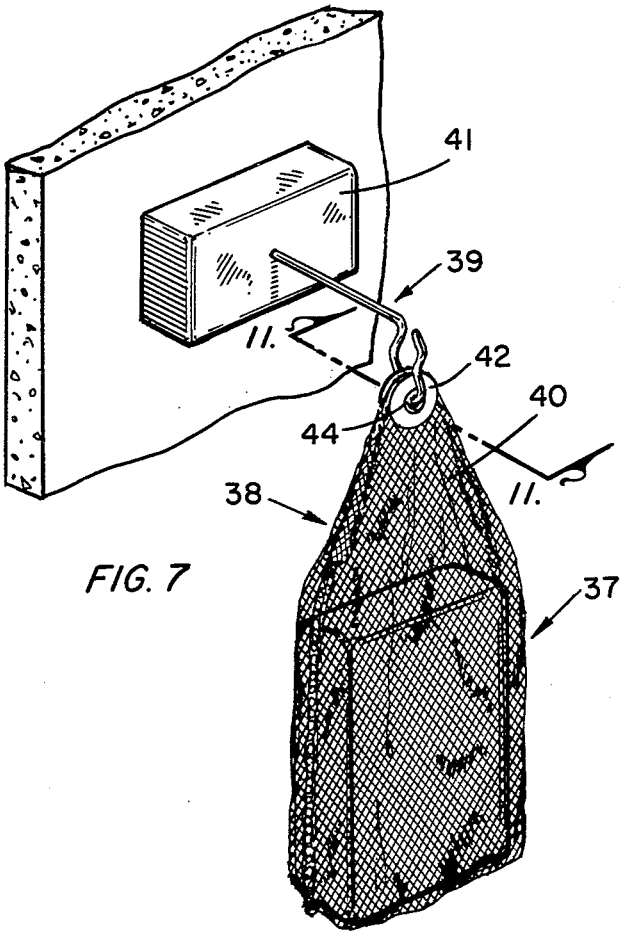
FIG. 7 is a perspective view of another embodiment of the soap holder and dispenser attached to a wall and holding a bar of soap.

Hanger 14 for the pouch 12 consists of an elongate member 24 formed from thin metal rod stock having a straight shank terminating in a hook 26 at one end and anchored at its other end in a round plastic base 28. The base 28 has a flat bottom adapted to be fastened to a wall surface, such as shown fragmentarily at 30 in FIG. 1, by means of a suitable adhesive. The wall surface can be in a shower, near a wash basin, or anywhere else within easy reach of one taking a shower, washing his hands, or in need of soap for any purpose. FIGS. 2, 3, 4 and 5 show various views of soap holder 10, the wall 30 to which it is shown affixed in FIG. 1 being omitted for better illustrative effect. Thus, in FIG. 3, the adhesive by means of which the base 28 is secured to wall 30 is shown at 32. FIG. 5, showing the bottom of soap holder 10, reveals that there is no seam in the bottom of pouch 12 since, as indicated above, the strip of netting from which the pouch is made was merely folded, not stitched, there.

Figure 6:
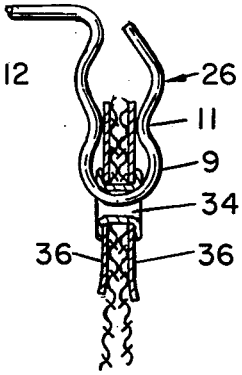
FIG. 6 is an enlarged fragmentary view, mostly in section, of an upper portion of the soap holder and dispenser, taken along the line 6—6 of FIG. 1.
Figure 8:
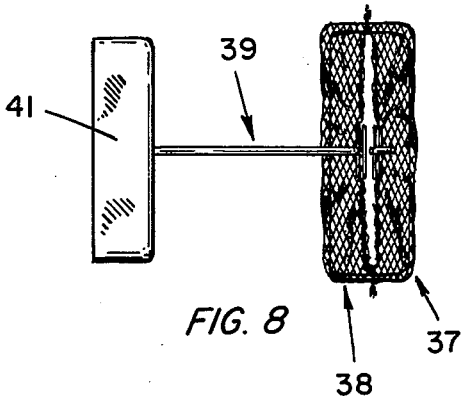
FIG. 8 is a top plan view of the soap holder and dispenser and bar of soap of FIG. 7.
Figure 10:
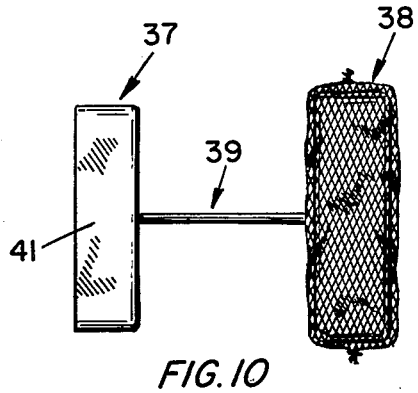
FIG. 10 is a bottom plan view of the soap holder and dispenser and bar of soap of FIG. 7.
Figure 9:
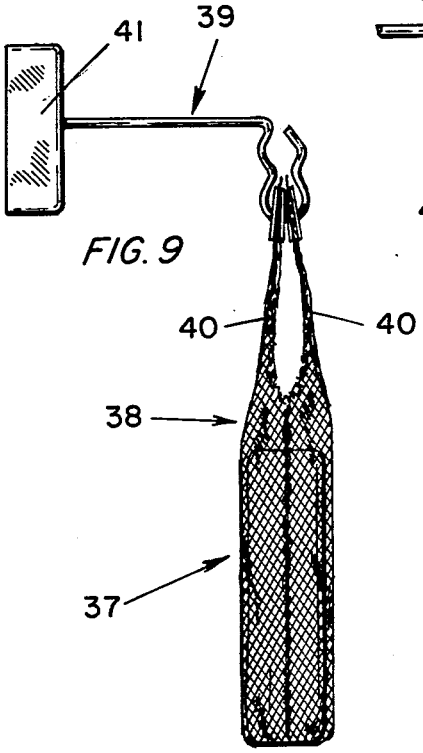
FIG. 9 is a side elevational view of the soap holder and dispenser and bar of soap of FIG. 7, the opposite side elevational view being a substantial mirror image thereof.

As best seen in FIG. 6, the hooked end of hanger 24 (hook 26) is shaped something like a FIG. 8, with a lower loop 9 disposed below a narrow waist 11 of the hook. The advantage of this shape is that the pouch 12 when suspended from lower loop 9 remains in position on the hanger with little or no possibility of dislodgement as a result of rough handling of the soap therein in a shower or elsewhere. Pouch 12 is provided with an eyelet 34 near the pointed tips of its flaps 19 by means of which it can be hung on hanger 14. The eyelet holds the flaps together, but there is sufficient space between each of their pairs of side edges (which space is shown at 35 in FIGS. 1 and 4) to permit a bar of soap to be slipped therethrough and into the lower, pocket portion of pouch 12. This pocket portion is shaped to receive the soap on edge in longitudinally horizontal position, although, as will be seen, its shape is not so limited and it can be designed to accommodate a bar of soap in longitudinally vertical position if desired. A pouch of the latter type is illustrated in FIGS. 7 through 11, presently to be described.

The netting material at the tips of flaps 19 of pouch 12 is reinforced against tearing stress at the position of eyelet 34 by the presence of a layer of patch material 36 on the outer side of each of the flap tips. This reinforcing material can, for example, be pieces of fabric of the type from which iron-on patches, commonly available in supermarkets and elsewhere, are made. Iron-on patches are cut in various shapes from khaki that has been coated on one side with a nontacky, heat-activatable adhesive material. Iron-on patches are typically used for patching the knees, elbows, etc., of children's clothing, for which purpose they are merely placed over an area to be patched, with the adhesive-coated side down, and then ironed with a very hot iron. The heat from the iron causes the adhesive to soften and adhere to the material being patched. My layers of patch material 36 are each cut in triangular shape to match the shape of the two tip ends of flaps 19, and they have been positioned on the outer sides of the flap tips, with their adhesive-coated sides in facing relationship, then pressed together and heated to soften the adhesive and cause it to hold them together through the mesh openings in the pouch flaps.

The two pieces of reinforcing material 36 can best be seen in FIG. 6 where, as illustrated, they permanently hold the tips of flaps 19 together by virtue of their adherence to one another through interaction of their heat-activated adhesive coatings. Eyelet 34 penetrates permanently the laminated, patchreinforced tips of flaps 19 and has an opening sized to slip loosely over the outer tip of hook 26 and down to the lower loop 9 of the hook to support pouch 12 in hanging position on the hook. Although I have previously indicated that eyelet 24 holds flaps 19 together, it will now be evident that this is true only in a limited sense and that the pieces of reinforcing material 36 actually serve more to permanently hold the tips of those flaps together than does the eyelet, although the latter provides insurance against complete separation of the tips should the adhesive on the reinforcing material fail to hold the involved parts together. It goes without saying, of course, that the adhesive on the two pieces of reinforcing material causes adherence not only of those pieces, but of each piece to strands of the netting in the flap farthest away therefrom (which it can reach through mesh openings in the nearest flap), to improve the overall bond between the affected parts. In FIG. 6 the thicknesses of those parts, or layers, are exaggerated, and the presence of the adhesive is omitted, for better illustrative effect.

As will be clear from the foregoing, the bar of soap 16 in pouch 12 is preferably used in the pouch while the latter is hanging on hook 26, the lather generated during such usage being free to pass through the mesh openings in the netting walls of the pouch. It is, however, possible to lift the pouch free of hanger 24, and use the soap (wrapped in the pouch netting) similarly to the way a free bar of soap is used in a shower or elsewhere. When so used. the rough-textured pouch netting serves somewhat the same purpose as a washrag, except with greater stimulus to the skin and more effective cleansing action than the latter.

Figure 11:
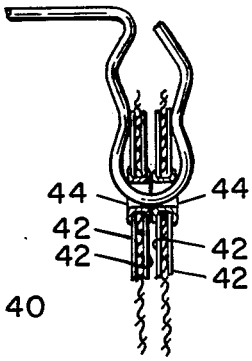
FIG. 11 is a fragmentary view, mostly in section, of an upper portion of the soap holder and dispenser of FIG. 7, taken along the line 11—11 of the latter figure.

FIGS. 7 through 11 show a second embodiment 37 of my novel soap holder, this one, as previously indicated, having a pouch shaped to receive a bar in longitudinally upright position. The principle difference between this embodiment and soap holder 10, aside from the shape of the soap holding pouch, shown at 38, is the presence of a separate eyelet 44 in each of the upper portions of pouch flaps, shown at 40, corresponding to flaps 19 of pouch 12. As can be seen, flaps 40 are much shorter than flaps 19, so short, in fact, as to leave an insufficient space between either pair of adjacent edges thereof for the insertion of a bar of soap into the pouch in the manner in which it can be inserted into pouch 12. For this reason, the flaps 40 are not fastened at the top and can be spread apart to admit such a bar. It is because of this construction that each flap has its own eyelet. Each of the eyelets is reinforced with the same iron-on patch material as is eyelet 34. Here, however, the reinforcement is in the shape of a ring formed from two pieces of the iron-on patch material positioned either side of the appropriate flap with their adhesive-coated sides facing. FIG. 11 shows the two reinforcing rings for each of the eyelets 34 at 42.

Figure 12:
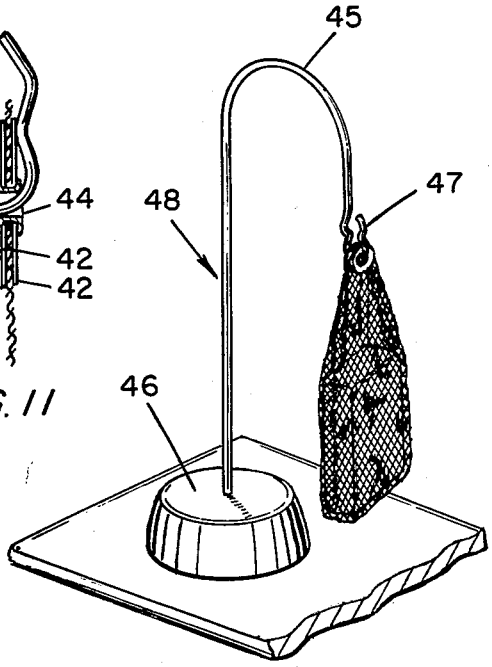
FIG. 12 is a perspective view of yet another embodiment of the soap holder and dispenser of this invention holding a bar of soap and mounted for use on a horizontal surface.

Soap holder 37 has a hanger 39 with a base 41 of rectangular, rather than round, periphery, but otherwise similar to base 28. The size and shape of this hanger base can, of course, vary widely within the scope of my invention. In this connection, the hanger can also vary in size and shape and take any form capable of supporting my novel soap holding pouch on any surface, vertical, horizontal or inclined. An embodiment of a soap holder suitable for use on a flat countertop or the like is shown in FIG. 12. This embodiment has a hanger 48 including a goosenecked member 45 anchored in a base 46 at one end and terminating in a hook 47 at the other end on which a pouch similar to pouch 38 is hung in the illustrated manner. The base 46 of this embodiment can be fastened on a horizontal surface near a sink, washbasin, or the like by means of a suitable adhesive, similarly to the way base 28 or base 41 is fastened to a wall.

Other embodiments of my invention suitable for use in special environments can be readily visualized. For example, a hook fastened to a string can serve as suitable hanger for a soap holding pouch in accordance with this invention at a campsite or other location where the string can be fastened to a tree limb or the like near a source of water for use by a camper or backpacker. Also, a soap holder otherwise similar to that illustrated in FIG. 12 can be provided with a stabilizing base of some sort to serve as a portable soap holder suitable for use by travelers, or movable as desired within the home or elsewhere. It goes without saying that hooks other than that of the FIG.-8 form illustrated in the drawings can be employed for purposes of this invention. Moreover, the hanger for my novel soap pouch can be made to swivel, for positional adjustment of the pouch, if desired, within the scope of the invention. By the same token, means other than eyelets can be used in lieu of the latter (as exemplified by eyelets 34 and 44) in the soap pouch of the invention.

While pouches such as described herein can be made from any type of netting, including cotton, linen, paper, etc., netting, only those made from man-made synthetic materials such as nylon, polyester and the like are believed to have practical utility for the purpose. This is because such synthetic materials are free of numerous weaknesses exhibited by cotton, paper, etc., when subjected to the environmental conditions to which my soap holder must be exposed in use. These weaknesses include vulnerability to mildew attack, souring, loss of structural integrity (rotting), bacterial infection, etc., upon repeated exposure to dampness.

For most effective utilization of my novel soap holder, the hanger support for wall-mount embodiments thereof should be designed to support a soap holding pouch far enough removed from a support wall to permit untrammeled use of a bar of soap in the pouch and minimize the possibility of soap sediment deposit then and subsequent soap drip on the wall. In the latter connection, however, I have observed that the freely suspended soap in the pouch dries quickly after use and exhibits substantially no drip between periods of such use.

While my novel soap holding means has been herein described and illustrated in what I consider to be preferred embodiments, it will be appreciated by those skilled in the art that the invention is not limited to those particular embodiments but includes within its scope all variant forms thereof encompassed by the language of the following claims. For example, a soap holding pouch in accordance with this invention might well be formed by molding or other means requiring no sewing step in its manufacture. As will be apparent from the present disclosure, my soap holder is sufficiently versatile to accommodate a soap bar of virtually any size, shape or brand. Moreover, it has wide adaptability for use anywhere soap is needed such as, for example, in medical and dental offices, hospitals, rest homes, dormitories, military barracks, business offices, restrooms and lounges, recreational vehicles, boats, etc. It should be noted that any person, even a blind one, can easily tell how much soap is present in my soap holding pouch at any time without having to open the top of the pouch or remove the pouch from its hanger.

I claim:

1. Soap holding and dispensing means particularly adapted for holding a bar of soap in hanging suspension in a convenient place for use comprising pouch means having a pocket sized and adapted to receive and contain such a bar, said pocket having a flexible wall formed from a piece of nylon tulle, which piece has been folded upon itself and is shaped to form two walls with side edges adjacent when so folded, said side edges being fastened together to form permanent side closures for said pocket;

said pouch means including a pair of generally triangular flaps formed from said piece of nylon tulle, said flaps being respectively integral with the folded walls of said pocket and extending outwardly therefrom to juxtaposition at their outer ends, the outer ends of said flaps being permanently laminated with each other and with laminar reinforcing means to form a composite laminate and said laminate being provided with an opening therethrough;

said flaps being sized to provide adequate permanent side entry spaces between said pocket and said laminate to permit a bar of soap to be placed in said pocket.

2. Soap holding and dispensing means in accordance with claim 1 including support means for supporting said pouch means containing a soap charge, said support means comprising hook means adapted to engage said opening to permit hanging support of the pouch means thereby.

3. Soap holding and dispensing means in accordance with claim 2 in which said hook means includes a hook in the shape of a FIG.-8 having a lower loop accessible to said opening and an upper loop with a gap adapted to receive the laminated outer ends of said flaps to permit threading of the hook through said opening and lowering of said laminate to said lower loop to thereby minimize the possibility of accidental disengagement of said pouch means from said hook when soap therein is being used.

* * * * *